US012213559B1

(12) United States Patent
Chehebar

(10) Patent No.: US 12,213,559 B1
(45) Date of Patent: Feb. 4, 2025

(54) FOOTWEAR WITH A COMPARTMENT FOR STORING A STRAP

(71) Applicant: FLIPSANDAL LICENSING, LLC, New York, NY (US)

(72) Inventor: Joseph Chehebar, New York, NY (US)

(73) Assignee: FLIPSANDAL LICENSING, LLC, New York, NY (US)

( * ) Notice: Subject to any disclaimer, the term of this patent is extended or adjusted under 35 U.S.C. 154(b) by 0 days.

(21) Appl. No.: 18/462,650

(22) Filed: Sep. 7, 2023

Related U.S. Application Data

(63) Continuation-in-part of application No. 29/909,292, filed on Aug. 3, 2023.

(51) Int. Cl.
*A43B 3/12* (2006.01)
*A43B 3/24* (2006.01)

(52) U.S. Cl.
CPC ..... *A43B 3/126* (2013.01); *A43B 3/122* (2013.01); *A43B 3/128* (2013.01); *A43B 3/24* (2013.01)

(58) Field of Classification Search
CPC ..... A43B 3/12; A43B 3/122; A43B 3/126; A43B 3/128; A43B 3/24
USPC ..... 36/11.5, 136
See application file for complete search history.

(56) References Cited

U.S. PATENT DOCUMENTS 2,069,752 A 2/1937 Dorr
2,340,027 A 1/1944 Story
2,669,036 A 2/1954 Sidney
3,978,596 A 9/1976 Brown et al.
4,051,610 A 10/1977 Shigeji
6,094,844 A * 8/2000 Potts ..... A43B 3/0031 36/136
D437,990 S 2/2001 Hooper
6,243,974 B1 * 6/2001 Schaj ..... A43B 3/108 36/11.5
D449,918 S 11/2001 Boncutter
D450,177 S 11/2001 Boncutter
D470,648 S 2/2003 Jacobs
(Continued)

FOREIGN PATENT DOCUMENTS

IN 363129-001-0001 8/2022
KR 301034038 11/2019

OTHER PUBLICATIONS

International Search Report in PCT/US2023/073771, mailed Jan. 24, 2024, 2 pages.

(Continued)

*Primary Examiner* — Marie D Bays
(74) *Attorney, Agent, or Firm* — ArentFox Schiff LLP

(57) ABSTRACT

Footwear capable of changing between a flip-flop or a slide into a sandal includes a sole including a forefoot section, an arch section, and a heel section. The footwear further includes a forefoot strap positioned and extending over at least a part of the forefoot section and being secured to the forefoot section of the sole. The footwear further includes a compartment located in the arch section of the sole, wherein the compartment houses a horizontal strap capable of moving between a first stored position within the compartment and a second raised position outside of the compartment. The footwear further includes a flap portion of the sole, wherein the flap portion covers the compartment and is capable of being lifted to access the horizontal strap in the compartment.

17 Claims, 20 Drawing Sheets

(56) References Cited

U.S. PATENT DOCUMENTS

| | | | | |
|---|---|---|---|---|
| 7,028,422 | B1 | 4/2006 | Lewis | |
| D549,933 | S | 9/2007 | Anderson et al. | |
| 7,284,341 | B2 | 10/2007 | Moseley | |
| 7,331,122 | B2 | 2/2008 | Januszewski et al. | |
| D576,388 | S | 9/2008 | del Biondi et al. | |
| D576,389 | S | 9/2008 | del Biondi et al. | |
| D580,130 | S | 11/2008 | Longley | |
| D606,731 | S | 12/2009 | Bridges | |
| D613,044 | S | 4/2010 | Fu | |
| D626,313 | S | 11/2010 | Nelson | |
| 7,823,299 | B1 * | 11/2010 | Brigham | A43B 3/24 36/11.5 |
| 8,132,342 | B1 | 3/2012 | Moon | |
| D661,067 | S | 6/2012 | Panariello, Jr. | |
| D661,473 | S | 6/2012 | Panariello, Jr. | |
| D673,353 | S | 1/2013 | Elze et al. | |
| 8,381,415 | B1 | 2/2013 | Lanoue et al. | |
| D694,995 | S | 12/2013 | Nguyen | |
| D753,907 | S | 4/2016 | Zavodny | |
| 9,301,568 | B2 | 4/2016 | Law | |
| D758,057 | S | 6/2016 | Zlatanovski et al. | |
| 9,380,836 | B1 | 7/2016 | Vigil | |
| D802,894 | S | 11/2017 | Hendrix et al. | |
| 10,244,813 | B2 | 4/2019 | Mitchell | |
| D854,792 | S | 7/2019 | McLellan et al. | |
| 10,441,021 | B1 | 10/2019 | Polk | |
| D874,102 | S | 2/2020 | Sullivan et al. | |
| D886,420 | S | 6/2020 | Grymes | |
| D924,547 | S | 7/2021 | Burg | |
| D928,472 | S | 8/2021 | Chen | |
| 11,439,196 | B2 | 9/2022 | Chehebar | |
| 11,457,686 | B1 | 10/2022 | Haynes | |
| D981,087 | S * | 3/2023 | Chehebar | D2/917 |
| 2005/0252036 | A1 * | 11/2005 | Laska | A43B 3/242 36/11.5 |
| 2006/0075656 | A1 | 4/2006 | Januszewski et al. | |
| 2006/0236561 | A1 | 10/2006 | Lee | |
| 2007/0175065 | A1 | 8/2007 | McDonald | |
| 2007/0193064 | A1 * | 8/2007 | Xu | A43B 3/0031 36/25 R |
| 2007/0199209 | A1 | 8/2007 | Schreck et al. | |
| 2008/0110056 | A1 | 5/2008 | Mann et al. | |
| 2008/0168682 | A1 | 7/2008 | Le | |
| 2009/0249655 | A1 | 10/2009 | Portnell | |
| 2010/0281713 | A1 | 11/2010 | Pantazes | |
| 2011/0056091 | A1 | 3/2011 | Shmurak et al. | |
| 2011/0203139 | A1 | 8/2011 | Eidson et al. | |
| 2011/0314692 | A1 | 12/2011 | Marmar et al. | |
| 2012/0042537 | A1 * | 2/2012 | Dimatteo | A43B 7/1464 36/11.5 |
| 2012/0152267 | A1 | 6/2012 | Chang | |
| 2012/0311886 | A1 | 12/2012 | Reno, III | |
| 2013/0174448 | A1 | 7/2013 | George | |
| 2014/0202030 | A1 | 7/2014 | Cheng | |
| 2014/0305002 | A1 * | 10/2014 | Murietta | A43B 3/122 36/11.5 |
| 2015/0007459 | A1 * | 1/2015 | Dimatteo | A43B 3/128 36/102 |
| 2015/0033584 | A1 | 2/2015 | Ferguson | |
| 2015/0047228 | A1 * | 2/2015 | Pernia | A43B 3/122 36/100 |
| 2015/0250264 | A1 * | 9/2015 | Hollander | A43B 23/25 2/245 |
| 2016/0015117 | A1 * | 1/2016 | Kizer | A43B 3/126 36/11.5 |
| 2017/0181493 | A1 | 6/2017 | Graffeo | |
| 2019/0021445 | A1 | 1/2019 | Eugene | |
| 2019/0328077 | A1 | 10/2019 | Reynolds | |
| 2020/0008515 | A1 | 1/2020 | Pellegrino | |
| 2020/0329808 | A1 | 10/2020 | Bialuk et al. | |
| 2020/0375303 | A1 | 12/2020 | Lasso | |
| 2022/0071337 | A1 * | 3/2022 | Chehebar | A43B 3/242 |

OTHER PUBLICATIONS

Written Opinion in PCT/US2023/073771, mailed Jan. 24, 2024, 6 pages.

Amazon Essential Women's Thin Two strap Sandal Flat, First available: Jul. 15, 2021 [Retrieved on Oct. 21, 2022]. Retrieved from the Internet <URL: https://www.amazon.com/dp/B08MXT94B9?ref_%20=cm_sw_r_cp_ud_dp_27728VE6W1EVZ2BFK173>, 7 pages.

Amazon Essentials Women's Two Band Sandal, First available: Nov. 28, 2020 [Retrieved on Oct. 21, 2022]. Retrieved from the Internet <URL:https://www.amazon.com/dp/B08LPTSH9W?ref_=cm_sw_r_cp_ud_dp_BZJPG29VFJEKWGC01AKV>, 7 pages.

Extended European Search Report in EP21020189.3, mailed Sep. 28, 2021, 8 pages.

Steve Madden Women's Dual Flat Sandal, First available: May 25, 2019, [Retrieved on Oct. 21, 2022]. Retrieved from the Internet <URL:https://www.amazon.com/dp/B082Z1 SBJ4?ref_ =cm_sw_r_cp_ud_dp_M99FHJY0Q1D74S4VH9WT>, 6 pages.

* cited by examiner

FOOTWEAR WITH A COMPARTMENT FOR STORING A STRAP

FIELD OF TECHNOLOGY

The present disclosure relates to footwear capable of changing between a flip-flop or a slide into a sandal. A flip-flop or a slide is provided with a movable horizontal strap located within a compartment in the arch section of the sole. The strap is movable to an extended position from the compartment so that the flip-flop or the slide also may function as a sandal.

BACKGROUND

A flip-flop or slide is a type of casual footwear worn especially outdoors or during warm climates or seasons. For example, flip-flops or slides may be worn while engaging in casual bathing activities at a beach or at a swimming pool. Flip-flops or slides, each has a simple structure and design, which provides convenience and easy wearability for their wearers. A flip-flop usually includes a flat sole loosely held on the wearer's foot by a Y-shaped or V-shaped strap known as a "toe thong" that passes between the first and second toes and around both sides of the foot. A slide is similar in configuration but replaces the toe thong with a horizontal strap that extends across the forefoot portion of the slide.

However, because of this simple design, flip-flops, for example, fail to provide a secure support for the foot, which can lead to injuries. More specifically, the insecure support provided by flip-flops can lead to injuries, including causing the wearer to: (a) inadvertently roll their feet which can cause sprains or bone fractures, (b) get tendonitis in their ankles as a result of the wearers overusing the tendons in their feet to try and compensate for the lack of support provided by their flip-flops, (c) have frictional issues, such as blisters, as a result of the thong straps rubbing against the wearers' feet during walking, and/or (d) experience cuts, scrapes, bruises, or stubbed toes as a result of the open toe design of flip-flops.

To avoid these types of injuries, many medical professionals and podiatrists recommend that people wear sandals instead of flip-flops. Unlike flip-flops, sandals are more secure and provide greater support for the wearer to help prevent injuries to the wearer's feet that are typically associated with loose fitting flip-flops. However, the additional support provided by sandal straps typically detracts from the convenience and easy access of wearing sandals.

SUMMARY

In view of the shortcomings of current flip-flops and slides, there is a need for footwear that provides the convenience and easy access found in a flip-flop or slide, for example, while also providing the additional support and safety for the wearer that is normally associated with sandals.

The present disclosure describes footwear that accomplishes the improved support and safety by providing a flip-flop or slide with an extendible strap located within a compartment within the sole of the footwear and can optionally be movable and secured to the wearer's foot—thus, providing greater foot support and security, when needed.

The present disclosure describes footwear capable of changing between a flip-flop or slide into a sandal. The footwear includes a sole including a forefoot section, an arch section and a heel section. A forefoot strap is positioned and extends over at least a part of the forefoot section and is secured to the forefoot section of the sole. The footwear further includes a compartment located in the arch section of the sole, wherein the compartment houses a horizontal strap capable of moving between a first stored position within the compartment and a second raised position outside of the compartment. The footwear further includes a flap portion of the sole, wherein the flap portion covers the compartment and is capable of being lifted to access the horizontal strap in the compartment.

The horizontal strap preferably is a single strap made of an elastic material to aid in adjusting the horizontal strap around, for example, the heel or ankle portion of the wearer's foot. Further, the horizontal strap includes two terminal ends. Typically, at least one of these terminal ends of the horizontal strap is attached in the compartment formed in the sole. In some aspects, when the horizontal strap is extracted from the compartment and the flap portion returns to the closed state, the horizontal strap extends from the sides of the flap portion.

The above simplified summary of example aspects serves to provide a basic understanding of the present disclosure. This summary is not an extensive overview of all contemplated aspects and is intended to neither identify key or critical elements of all aspects nor delineate the scope of any or all aspects of the present disclosure. Its sole purpose is to present one or more aspects in a simplified form as a prelude to the more detailed description of the disclosure that follows. To the accomplishment of the foregoing, the one or more aspects of the present disclosure include the features described and exemplarily pointed out in the claims.

BRIEF DESCRIPTION OF THE DRAWINGS

The accompanying drawings, which are incorporated into and constitute a part of this specification, illustrate one or more example aspects of the present disclosure and, together with the detailed description, serve to explain their principles and implementations.

DETAILED DESCRIPTION

Those of ordinary skill in the art will realize that the following description is illustrative only and is not intended to be in any way limiting. Other aspects will readily suggest themselves to those skilled in the art having the benefit of this disclosure. Reference will now be made in detail to implementations of the example aspects as illustrated in the accompanying drawings. The same reference indicators will be used to the extent possible throughout the drawings and the following description to refer to the same or like items.

The present disclosure describes footwear capable of changing between a flip-flop or slide into a sandal. When functioning as a flip-flop or a slide, a horizontal strap is stored within a compartment, which is located or embedded in a sole of the footwear, and a flap or flap portion of the sole is in a closed state. When converting the footwear to a sandal, the horizontal strap is extracted from the compartment by lifting the flap portion to an open state, and subsequently closing the flap portion to the closed state, while keeping horizontal strap outside of the compartment. When functioning as a sandal, the compartment remains closed and the horizontal strap is extended onto a portion of the wearer's foot. For example, the horizontal strap may be stretched or fastened around the heel portion of the wearer's foot, depending on the wearer's preference. In this position, the wearer's foot is secured to the footwear by their toes being secured by a forefoot strap, and by the heel portion of their feet being secured by the horizontal strap.

Figure 1:
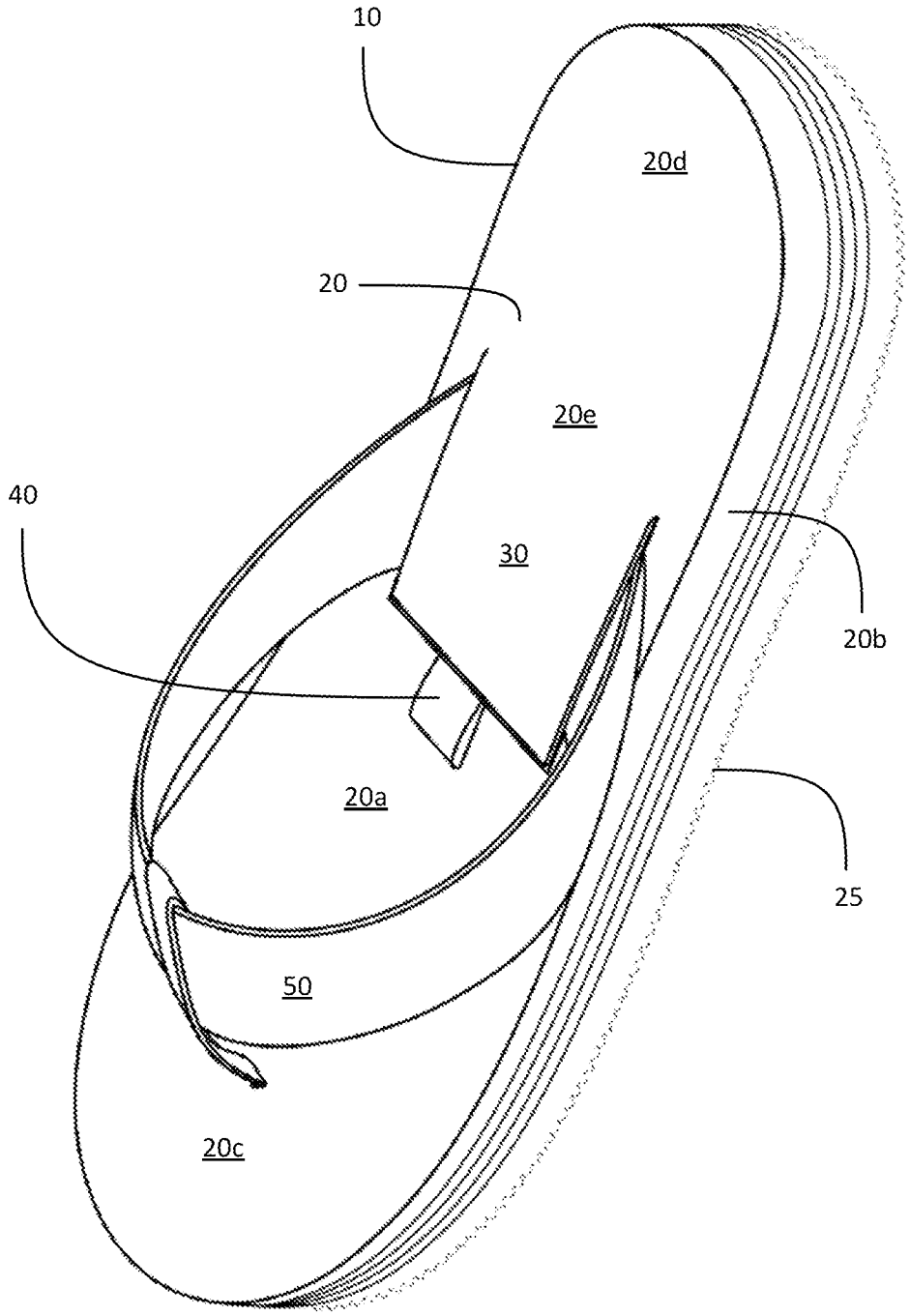
FIG. 1 is a front view of footwear functioning as a flip-flop with a horizontal strap stored in a compartment.
Figure 2:
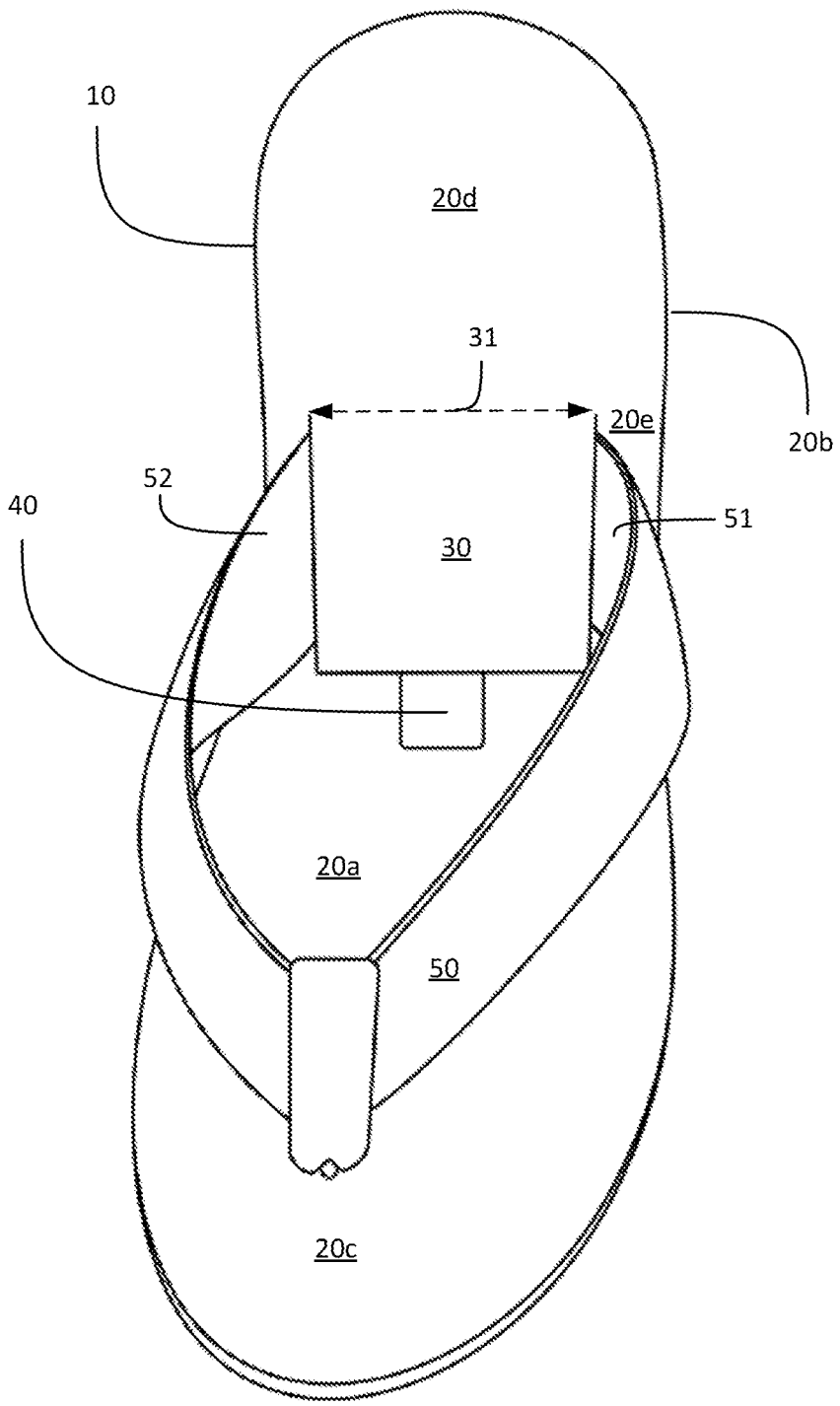
FIG. 2 is a top view of footwear functioning as a flip-flop with the horizontal strap stored in the compartment.

FIG. 1 is a front view of footwear 10 functioning as a flip-flop with a horizontal strap stored in a compartment. FIG. 2 is a top view of footwear 10 functioning as a flip-flop with the horizontal strap stored in the compartment.

In FIGS. 1 and 2, the compartment is covered by flap portion 30. The structure of footwear 10 includes a sole 20 having a top section 20*a*, a sidewall section 20*b*, a forefoot section 20*c*, a heel section 20*d*, an arch section 20*e* and a bottom section 25. The sole 20 may be formed of materials including: rubber, vulcanized rubber, leather, ethyl vinyl acetate (EVA), polyurethane, dual density SSR, or any other synthetic or natural materials known in the art for constructing footwear soles.

Figure 15:
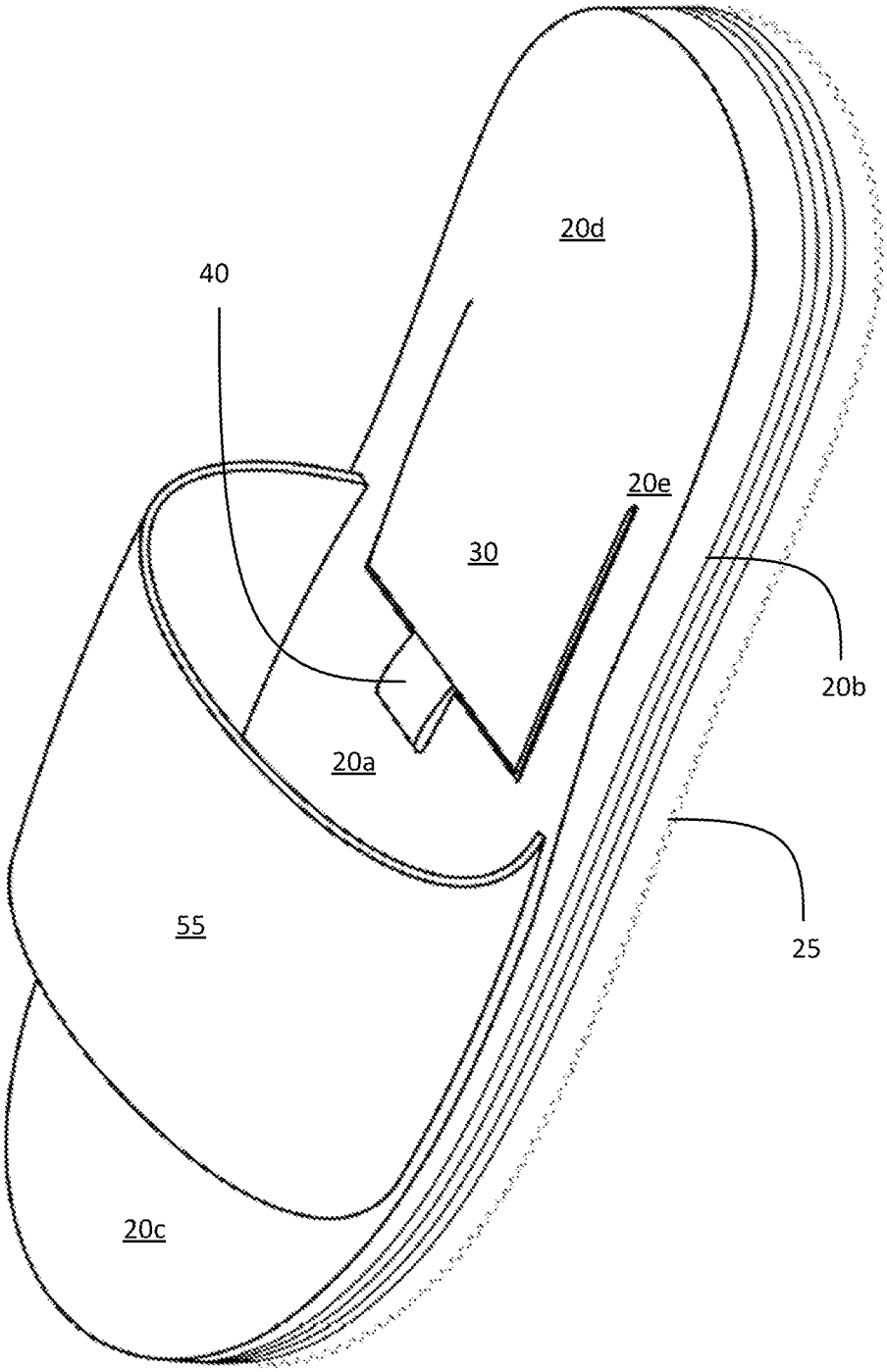
FIG. 15 is a front view of footwear functioning as a slide with a forefoot strap and a horizontal strap stored in a compartment.

Footwear 10 further includes a forefoot strap 50 having a V-shape or Y-shape (i.e., taking the shape of a "toe thong"). Forefoot strap 50 passes between a first and second toe and around both sides of a foot. However, forefoot strap 50 may also have any other shape that is desired by the user. For example, as shown in FIG. 15, the forefoot strap may be a wide forefoot strap 55 that passes around both sides of a foot, but does not pass through any toes (e.g., thus structured as a "slide"). Forefoot strap 50 is positioned and extends over at least a part of forefoot section 20*c* and is attached to top section 20*a* of sole 20. Forefoot strap 50 is preferably comprised of elastic material and may be formed from synthetic fabric but may alternatively be composed of any material such as leather, nylon, or any other material known within the field. Further, forefoot strap 50 may be attached to sole 20 using rivets, screws, latch members, adhesives (e.g., glue), or any other means known within the art. Alternatively, instead of mechanically attaching forefoot strap 50 to sole 20, forefoot strap 50 and sole 20 may be a molded as a single unit of footwear construction.

In an exemplary aspect, when flap portion 30 is in a closed state, the surface of flap portion 30 sits flush with the rest of sole 20. This prevents the wearer from experiencing discomfort when resting their foot on sole 20 because the edges of flap portion 30 do not protrude significantly from the rest of sole 20.

In one aspect, flap portion 30 is a cutout in arch section 20*e* of sole 20. Accordingly, the compartment is positioned between top portion 20*a* and heel portion 20*d*. In one aspect, flap portion 30 may be formed by three carved edges in sole 20. In one aspect, a first edge of flap portion 30 receives terminal end 52 of forefoot strap 50 and a second edge of flap portion 30 receives terminal end 51 of forefoot strap 50. The final edge may be perpendicular to both the first edge and the second edge and is connected to grip element 40. In one example, the first and second edges may be 2 inches long and the third edge may be 2.25 inches long.

Grip element 40 may include two terminal ends that are connected to the third edge of flap portion 30 and form a loop. Grip element 40 enables a wearer to lift flap portion 30 when in a closed state. In one aspect, grip element 40 is disposed near or about the center of the edge of flap portion 30, where said third edge is opposite pivot line 31. When the wearer pulls grip element 40 in an upward direction, flap portion 30 is lifted about pivot line 31. Grip element 40 may be made of a soft material (e.g., a fabric), which prevents irritation or discomfort when a foot is rested on sole 20.

Figure 3:
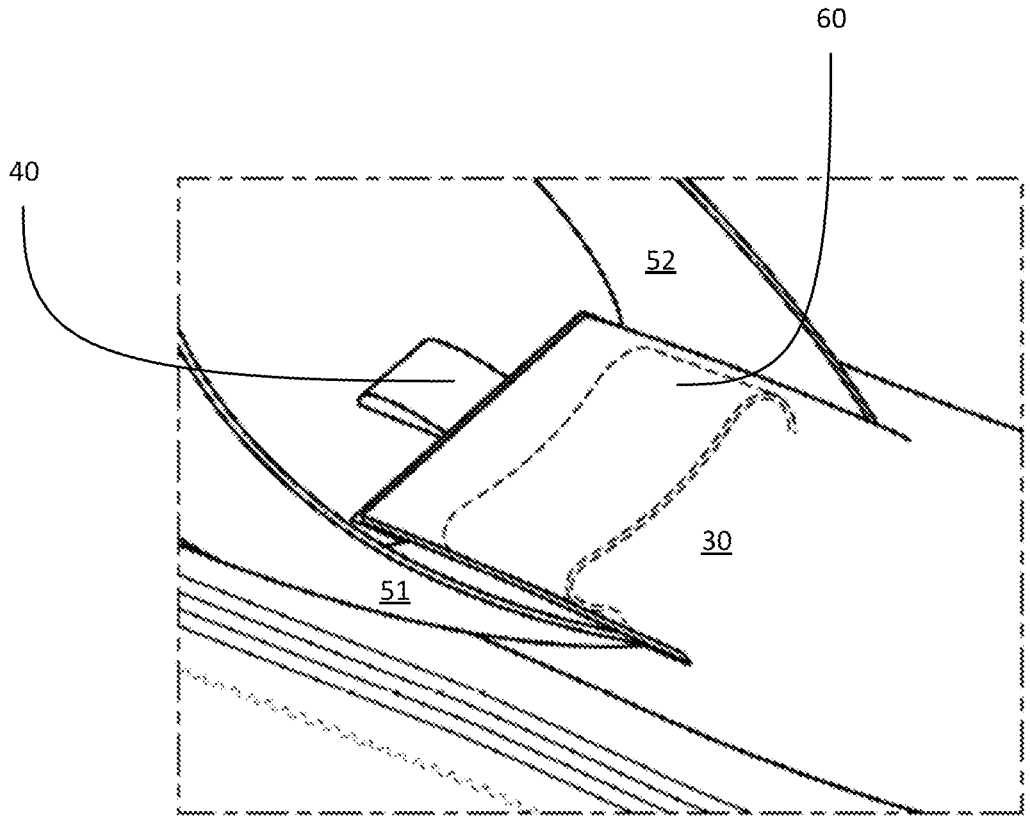
FIG. 3 is a view of the horizontal strap stored underneath a flap portion of the sole.

FIG. 3 is a view of horizontal strap 60 stored underneath flap portion 30 of sole 20. When stored in the compartment, horizontal strap 60 may be folded to prevent horizontal strap 60 from protruding through the edges of flap portion 30. In one aspect, a length of horizontal strap 60 may be proportional to a width of flap portion 30 (i.e., four times the width). This allows horizontal strap 60 to be evenly folded (e.g., two half holds) in compartment 90. As shown in FIG. 3, the width of flap portion 30 may be such that the terminal ends 51 and 52 can be received by compartment 90. Compartment 90 may have a width that is less than or matches the width of flap portion 30.

Figure 4A:
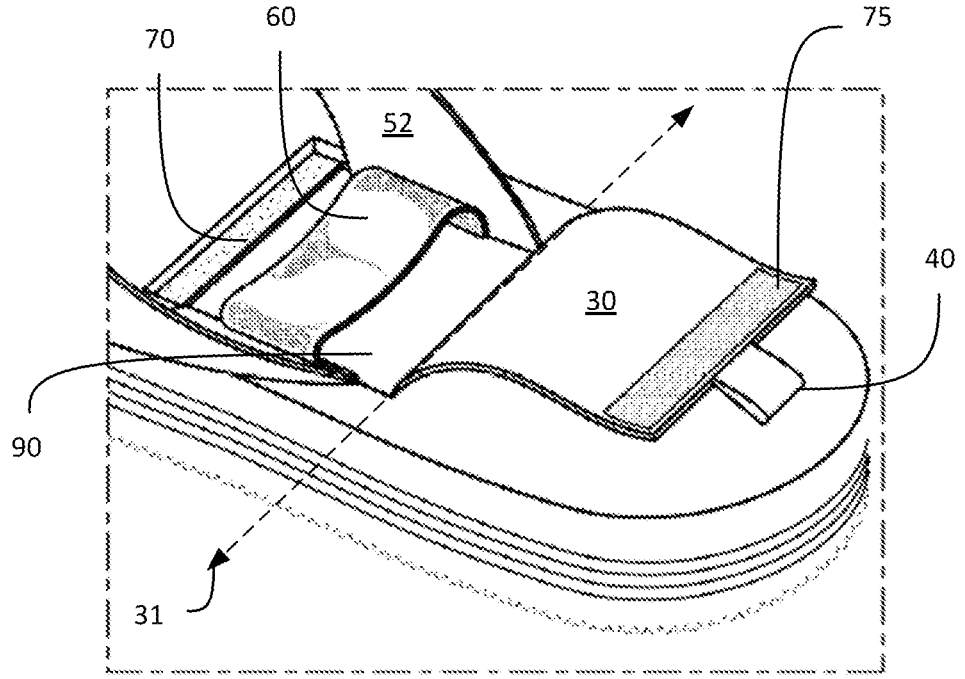
FIG. 4A is a demonstrative view showing the flap portion being lifted.
Figure 4B:
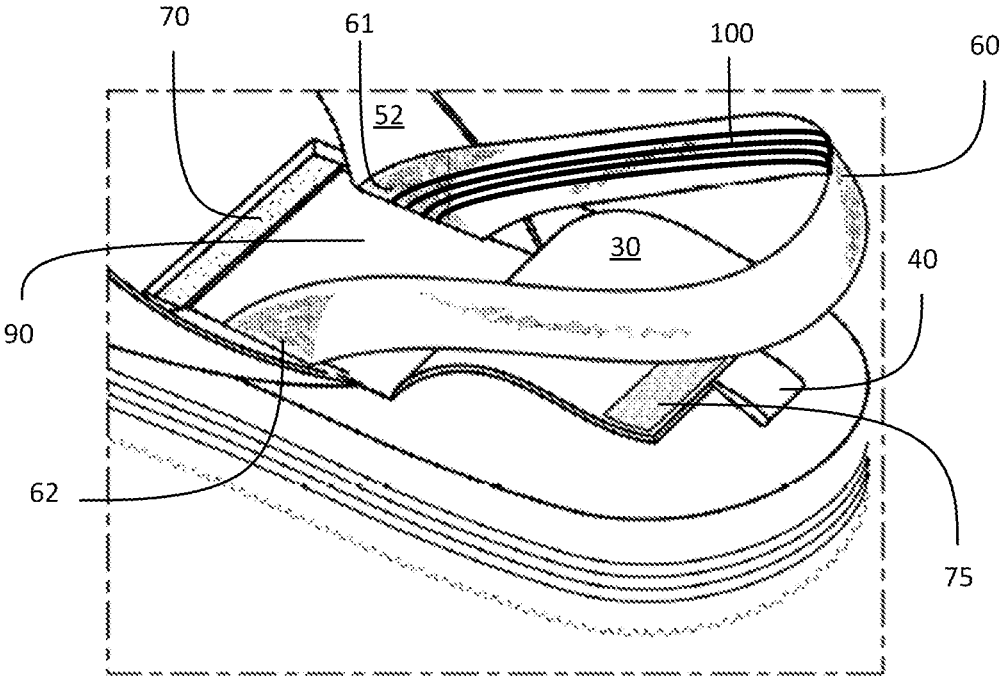
FIG. 4B is a demonstrative view showing the extraction of the horizontal strap from the compartment.

FIG. 4A is a demonstrative view showing the flap portion 30 being lifted. FIG. 4B is a demonstrative view showing the extraction of horizontal strap 60 from compartment 90. As shown in FIG. 4A, flap portion 30 is opened about pivot line 31. In one aspect, pivot line 31 is provided by a hinge connected to sole 20. For example, the hinge may be a mechanical attachment made with a soft material that does not discomfort the foot of the wearer. In another aspect, flap portion 30 may be seamlessly integrated into sole 20 such that lifting flap portion 30 involves bending flap portion 30 about pivot line 31. In one aspect, sole 20 may be made of a bendable material such that when released from the opened state, flap portion 30 bends towards the closed state due to the elasticity of the bendable material. Depending on the elasticity of the bendable material, flap portion 30 may return to a closed state or may enter a partially closed state (e.g., where the angle formed between flap portion 30 and sole 20 is less than 45 degrees) when released from the open state.

In order to ensure that flap portion 30 remains in a closed state, fastening elements are provided in compartment 90 and flap portion 30. For example, compartment 90 may include a first fastening element 70 that connects to a second fastening element 75 disposed on flap portion 30. As shown in FIG. 4, second fastening element 75 is attached to a bottom section of flap portion 30 and is not visible when flap portion 30 is in a closed state. In one aspect, first fastening element 70 and second fastening element 75 are hook-and-loop fasteners.

As shown in FIG. 4B, horizontal strap 60 includes two terminal ends 61 and 62, and at least one of said terminal ends 61 and 62 is attached by a buckle, a snap, an adhesive, or a hook and loop fastener to sole 20. More specifically, at least one of said terminal ends 61 and 62 is attached by a buckle, a snap, an adhesive, or a hook and loop fastener within compartment 90. In some aspects, said terminal ends 61 and 62 are attached to the sole 20 at two different positions, one being in proximity to the medial side of the sole 20 and the other being in proximity to the lateral side of the sole 20. In some aspects, these positions are within 0.25, 0.5, 0.75, or 1.0 inches from the medial and lateral sides, respectively (or at a distance within a range defined by any pair of the foregoing lengths). The attachment points may be located at the same longitudinal position of the sole as the terminal end 52 of forefoot strap 50 (as shown, e.g., in FIGS. 3 and 4). However, in other embodiments the attachment points may be located at an offset position (e.g., closer to the forefoot or heel area of the sole, as compared to the terminal end 52 of forefoot strap 50).

As shown in view 4B, horizontal strap 60 is capable of moving between a first stored flat position within compartment 90 and a second in-use raised position. In the second in-use raised position, horizontal strap 60 extends above compartment 90 to, for example, extend around the ankle of the wearer's foot. In this respect, horizontal strap 60 permits footwear 10 to function as a sandal and provides greater support for the wearer's foot, in addition to the support provided by the "toe thong" construction of the forefoot strap 50.

Horizontal strap 60 is preferably formed of synthetic elastic fabric to aid in adjusting horizontal strap 60 around, for example, the ankle of the wearer's foot. Horizontal strap 60 may alternatively be formed from any natural or synthetic materials such as rubber, leather, nylon, or any other material known within the art. In one aspect, the inner surface of horizontal strap 60, which makes contact with the foot of the wearer, is lined with a pattern 100. Pattern 100 may be one or more horizontal lines of varying thickness that extend from one end of horizontal strap 60 to an opposite end of horizontal strap 60. Pattern 100 is made of a material that enables horizontal strap 60 to grip the foot of the wearer. For example, the material may be silicone, plastic, rubber, etc.

In some aspects, horizontal strap 60 may include various adjusters for adjusting the length of horizontal strap 60 to provide a tighter fit around the wearer's foot, as desired. Adjusters may include buckles, cinches, loops or any other mechanical devices known within the art for tightening or controlling the length of horizontal strap 60.

In one aspect, compartment 90 has a first depth (e.g., 0.5 inches) and flap portion has a second depth (e.g., 0.25 inches). When in a closed state, flap portion 30 sits flush with sole 20 leaving a storage area within compartment 90 with a third depth (e.g., 0.25 inches) that is a difference of the first depth and the second depth. This storage area is where horizontal strap 60 remains stored (e.g., folded) until extracted.

Figure 5:
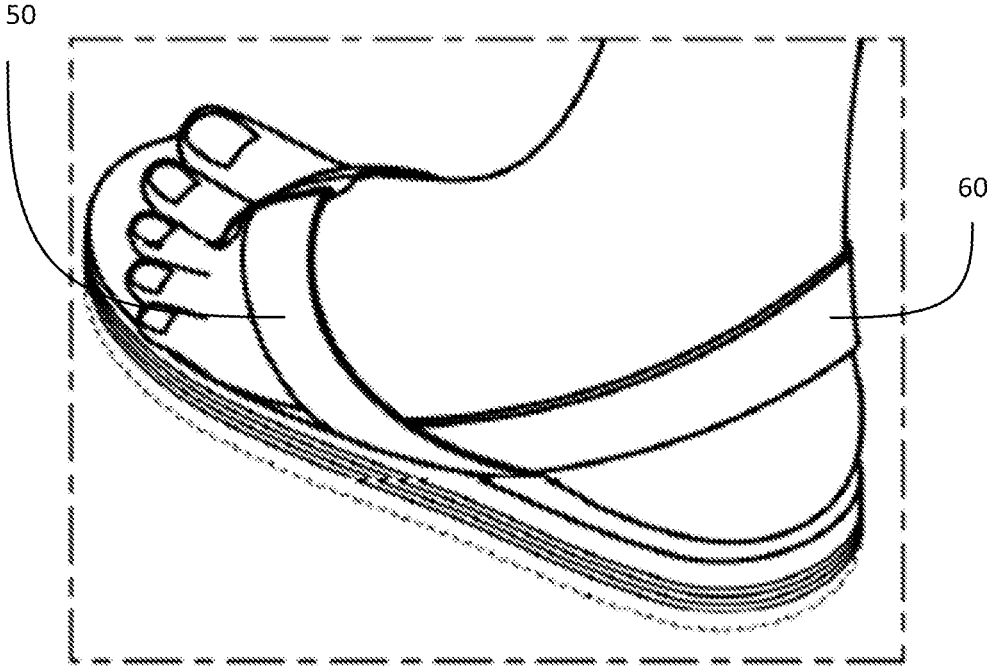
FIG. 5 is a demonstrative view showing the horizontal strap during wear.

FIG. 5 is a demonstrative view of utilizing horizontal strap 60 during wear. In FIG. 5, horizontal strap 60 is stretched around the hindfoot region (e.g., ankle) of the wearer's foot. In this demonstrative view, horizontal strap 60 is placed above the heel of the wearer. Accordingly, horizontal strap 60 adds an element of security and hold on the wearer's foot and prevents footwear 10 from sliding off.

Figure 6:
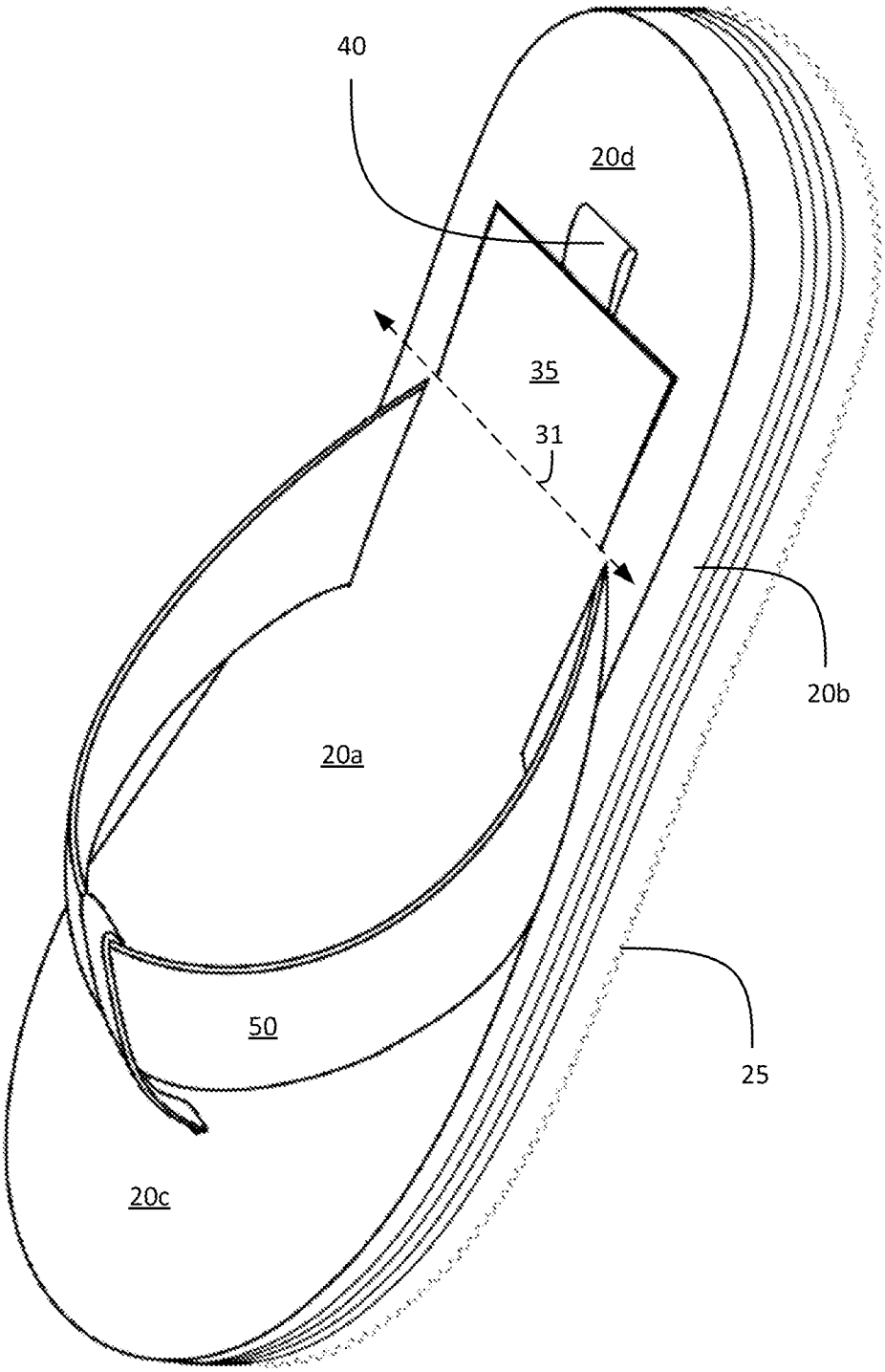
FIG. 6 is a view of footwear functioning as a flip-flop with an alternative compartment located in the sole.

FIG. 6 is a view of footwear 10 functioning as a flip-flop with alternative compartment 95 located in a different area of sole 20 and alternative flap portion 35 that opens in an opposite direction. Alternative flap portion 35 shares the same characteristics with flap portion 30 aside from two factors. First, unlike flap portion 30 which, when lifted, moves towards heel section 20*d* and, when closing, moves towards top section 20*a*, alternative flap portion 35, when lifted, moves towards top section 20*a* and, when closing, moves towards heel section 20*d*. Second, alternative compartment 95 is rotated by 180 degrees within arch section 20*e* and no longer receives the terminal ends of forefoot strap 50. Accordingly, the terminal ends do not protrude out from the edges of alternative flap portion 35. In this case, the terminal ends of forefoot strap 50 are received by top section 20*a* of sole 20. In terms of positioning, alternative compartment 95 may be flipped about pivot line 31 such that it mirrors compartment 90 shown in FIG. 2.

Figure 7:
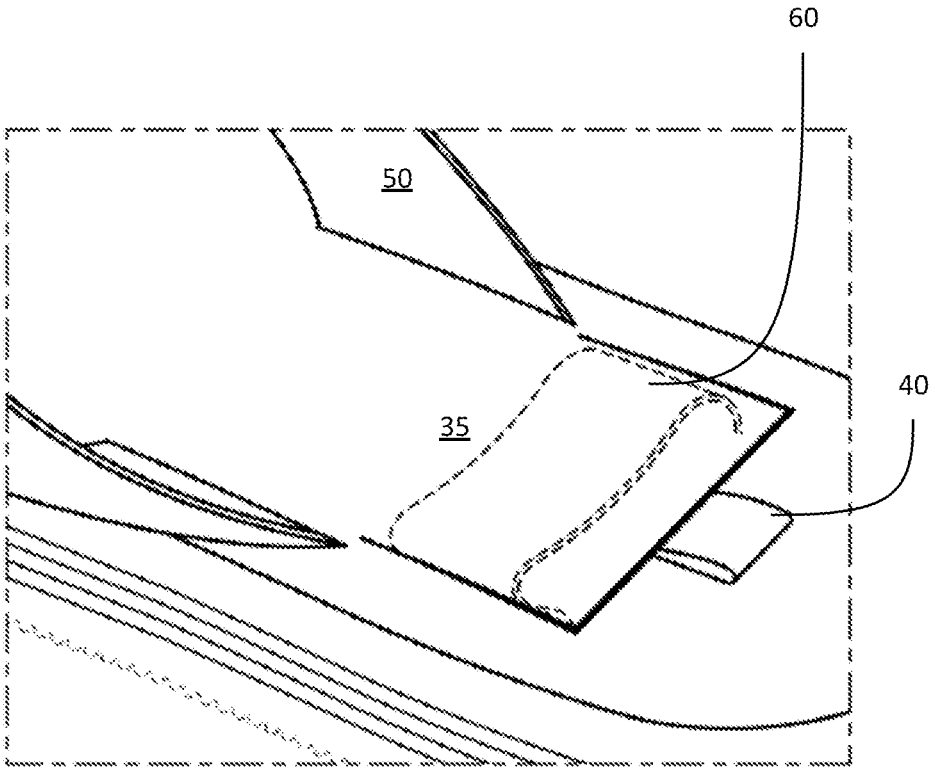
FIG. 7 is a view of the horizontal strap stored underneath a flap portion of the alternative compartment.
Figure 8A:
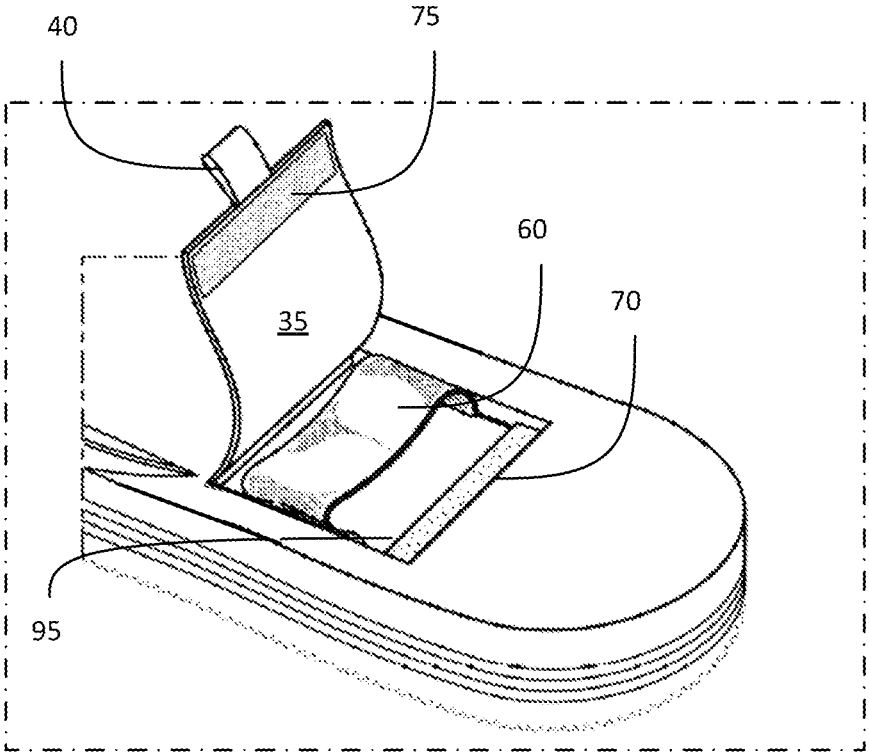
FIG. 8A is a demonstrative view showing the flap portion being lifted.
Figure 8B:
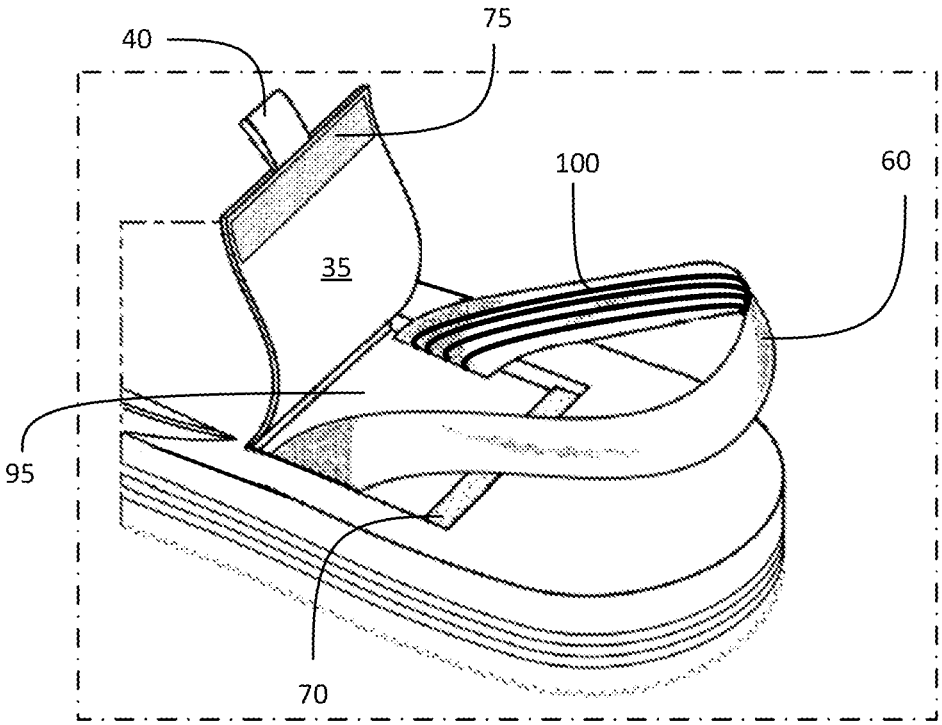
FIG. 8B is a demonstrative view of extracting the horizontal strap from the alternative compartment using the flap portion.

FIG. 7 is a view of horizontal strap 60 stored underneath alternative flap portion 35 of alternative compartment 95. FIG. 8A is a demonstrative view showing the alternative flap portion 35 being lifted. FIG. 8B is a demonstrative view of extracting horizontal strap 60 from alternative compartment 95 using alternative flap portion 35. In this case, fastening elements 70 and 75 are disposed in an opposite direction relative to the fastening elements shown in FIG. 4. Unlike FIG. 4, where horizontal strap 60 is extracted from compartment 90 towards the lifted flap portion 30, in FIG. 8, horizontal strap 60 is extracted from compartment 90 in a direction away from the lifted flap portion 30.

Figure 9:
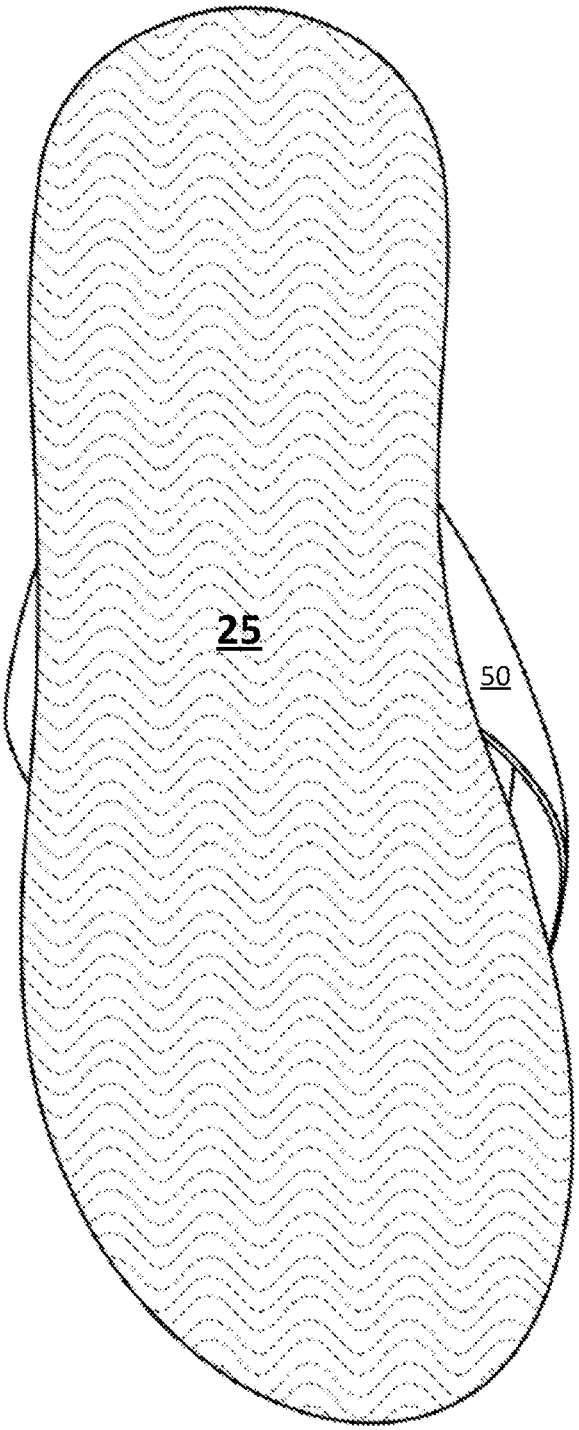
FIG. 9 is a bottom view of footwear.

FIG. 9 is a bottom view of footwear 10. In some aspects, bottom section 25 features a ridge pattern that increases friction between the surface on which footwear 10 is placed and bottom section 25. This enables greater grip.

Figure 10:
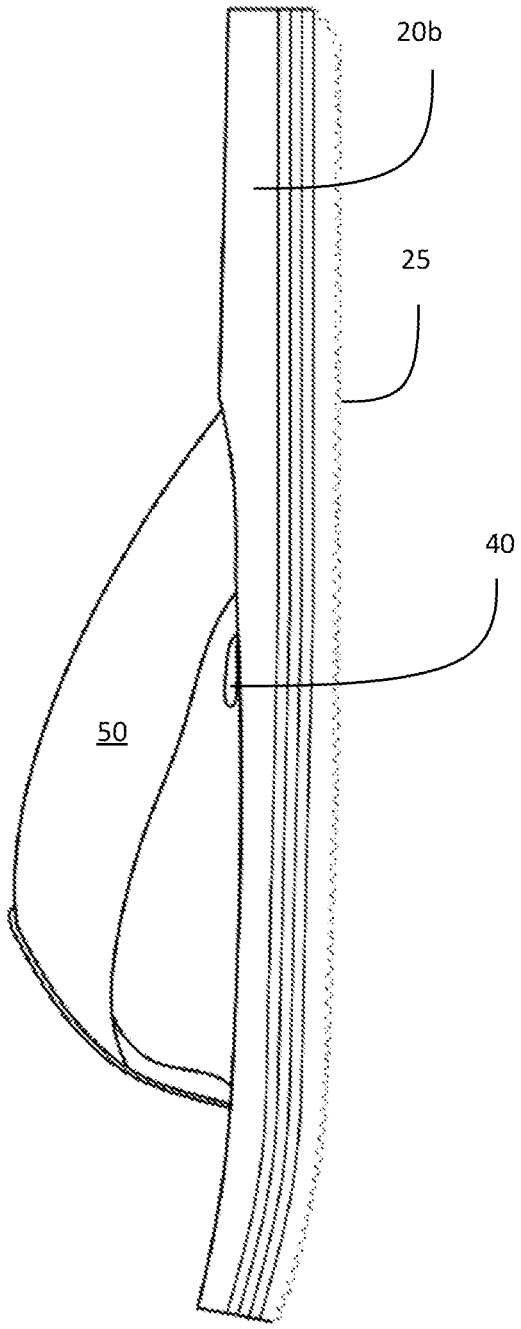
FIG. 10 is a first side view of footwear.
Figure 11:
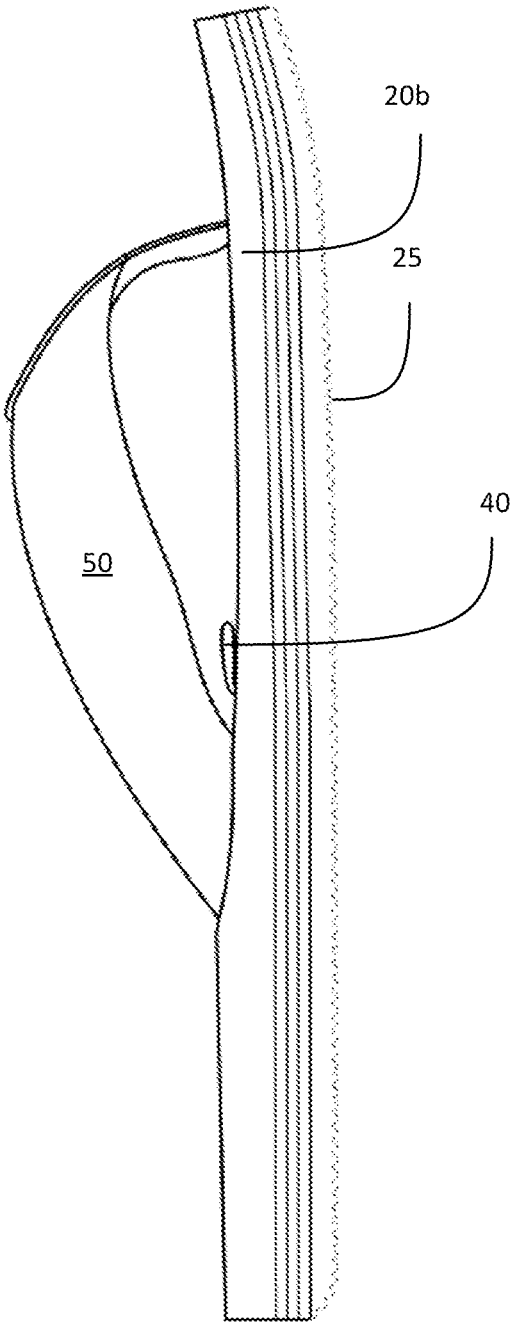
FIG. 11 is a second side view of footwear.

FIG. 10 is a first side view of footwear 10. FIG. 11 is a second side view of footwear 10. As shown in FIGS. 10 and 11, the outer surface of flap portion 30 (and also alternative flap portion 35) sit flush against the surface of sole 20. Grip element 40 protrudes out of the third edge of flap portion 30 to enable the wearer to easily lift flap portion 30.

Figure 12:
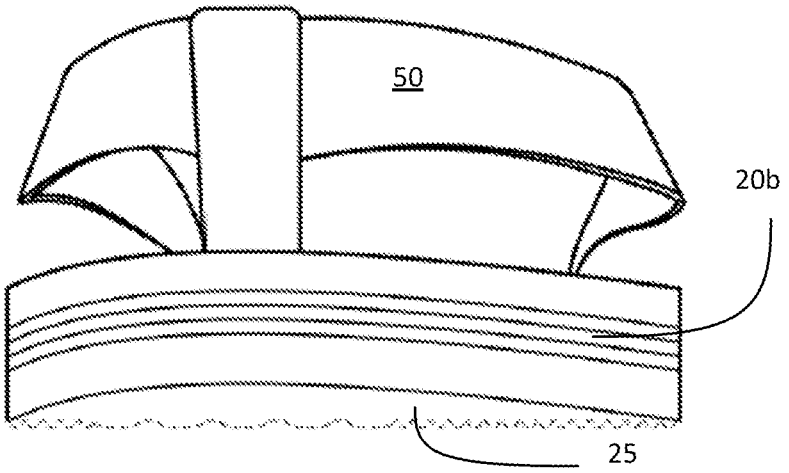
FIG. 12 is a front view of footwear.
Figure 13:
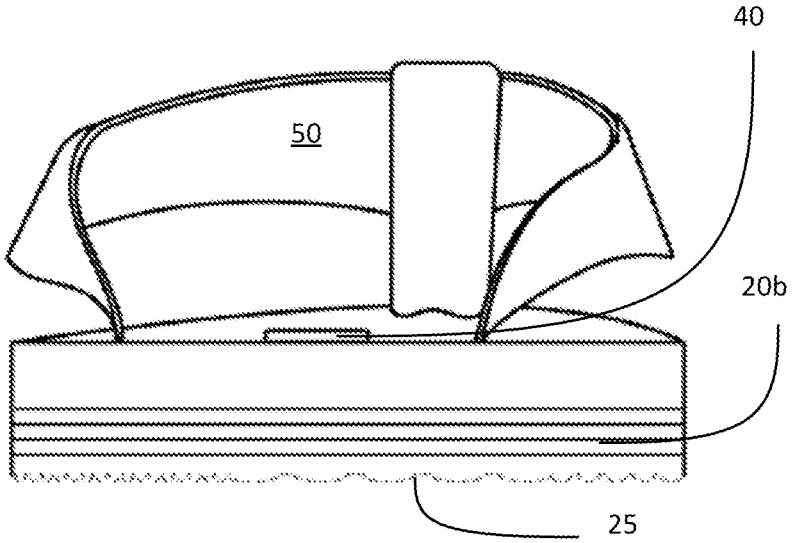
FIG. 13 is a rear view of footwear.

FIG. 12 is a front view of footwear 10. FIG. 13 is a rear view of footwear 10. In some aspects, sole 20 curves upward toward forefoot section 20*c*. For example, in FIG. 12, the surface of bottom section 25 is visible from the front view due to the raised curvature. In contrast, the surface of bottom section 25 is not visible from the rear view because sole 20 sits flat on the floor surface towards heel section 20*a*. This curvature of sole 20 makes walking/running easier for the wearer.

Aside from the attributes that will be specified below, footwear 10 described in FIGS. 1-13 is functionally and dimensionally equivalent to footwear 10 described in FIGS. 14-21. To avoid redundancy, only distinctive attributes are described.

Figure 14:
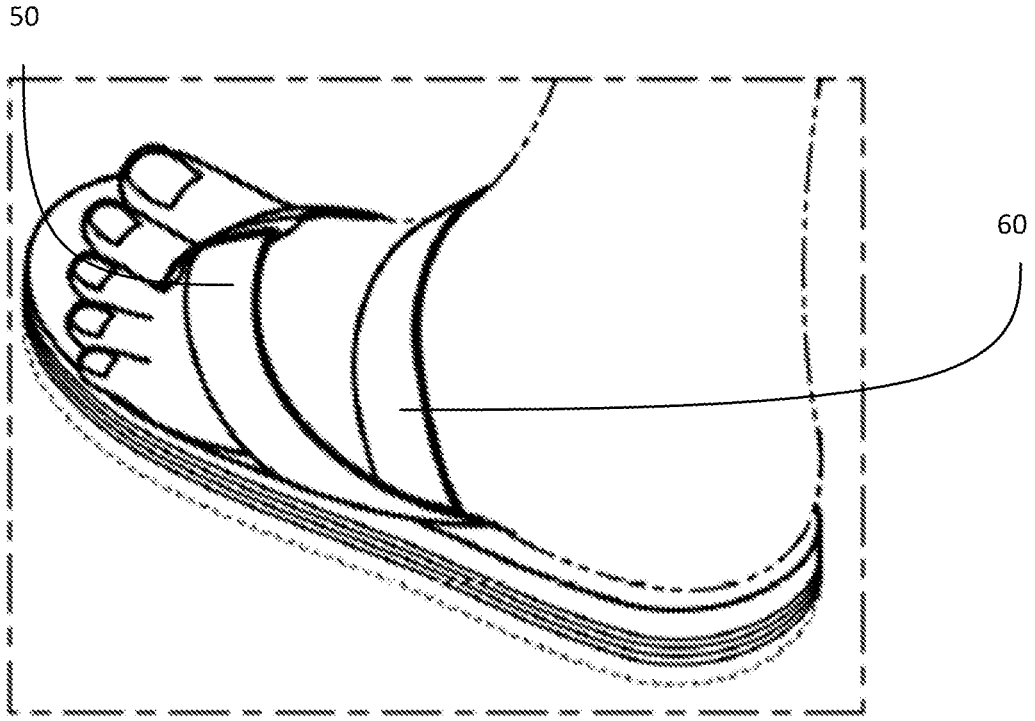
FIG. 14 is a demonstrative view showing the horizontal strap during wear.

FIG. 14 is a demonstrative view showing the horizontal strap during wear. In FIG. 14, horizontal strap 60 is stretched across the midfoot region of the wearer's foot. As mentioned previously, this allows horizontal strap 60 to provide an element of security by holding onto the wearer's foot and preventing footwear 10 from sliding off.

FIG. 15 is a front view of footwear 10 functioning as a slide with wide forefoot strap 55 and horizontal strap 60 stored in compartment 90. Wide forefoot strap 55 passes around both sides of a foot but does not pass through any toes (unlike forefoot strap 50). The width of wide forefoot strap 55 may cover the midfoot region of a wearer's foot. This secures footwear 10 on the foot in slide mode. For example, while forefoot strap 50 may be 0.5 inches to 1 inch in width, the width of wide forefoot strap 55 may be 1 inch to 3 inches.

Furthermore, unlike forefoot strap 50 described in FIG. 1, the terminal ends of wide forefoot strap 55 are not received by compartment 90 or flap portion 30. Instead, the terminal ends of wide forefoot strap 55 are received by one or more areas of top section 20*a* and forefoot section 20*c*.

Figure 16:
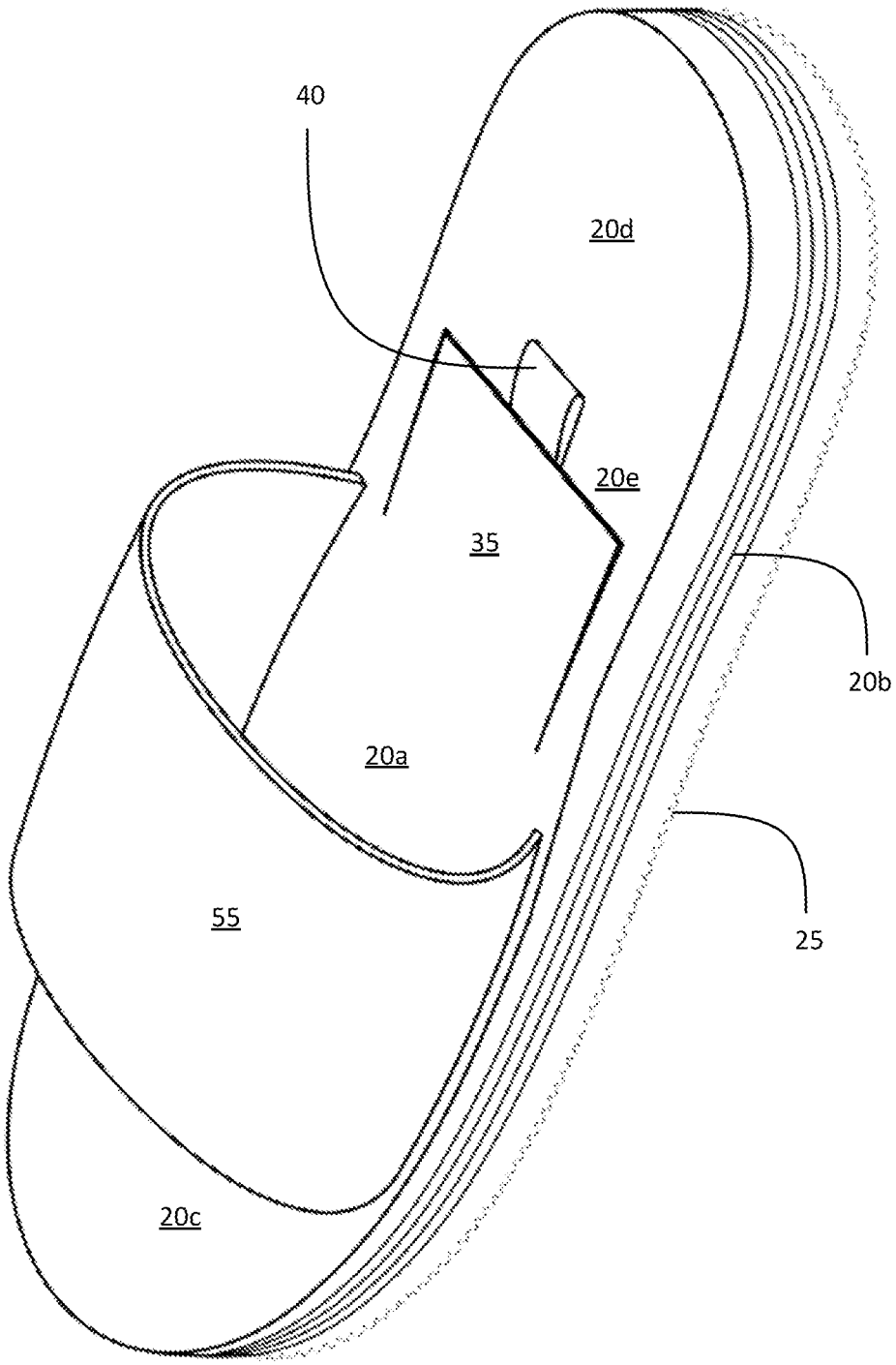
FIG. 16 is a front view of footwear functioning as a slide with the forefoot strap and the horizontal strap stored in the compartment with a flap portion.

FIG. 16 is a front view of footwear 10 functioning as a slide with wide forefoot strap 55 and horizontal strap 60 stored in alternative compartment 95 with alternative flap portion 35.

Figure 17:
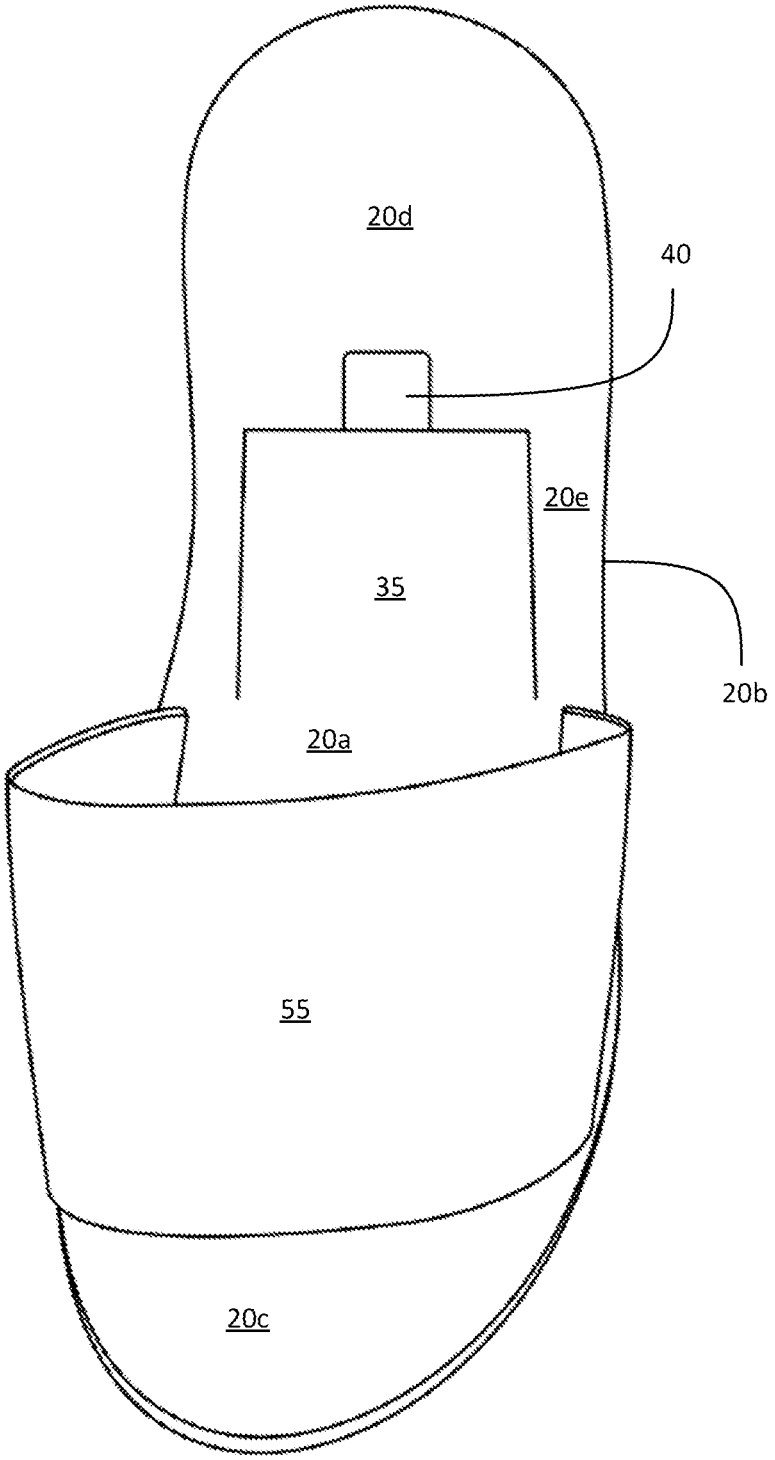
FIG. 17 is a top view of footwear functioning as a slide with the forefoot strap and the horizontal strap stored in the compartment with the flap portion.

FIG. 17 is a top view of footwear 10 functioning as a slide with wide forefoot strap 55 and horizontal strap 60 stored in alternative compartment 95 with alternative flap portion 35.

Figure 18:
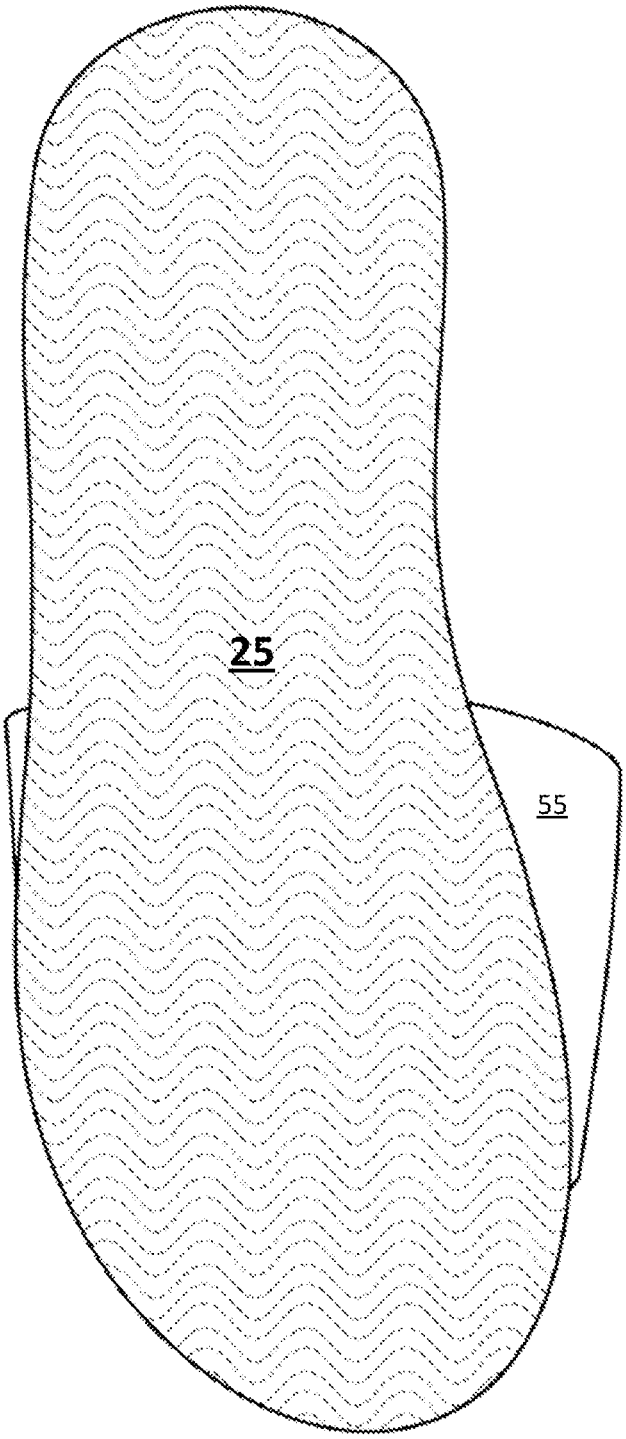
FIG. 18 is a bottom view of footwear with the forefoot strap.

FIG. 18 is a bottom view of footwear 10 with wide forefoot strap 55.

Figure 19:
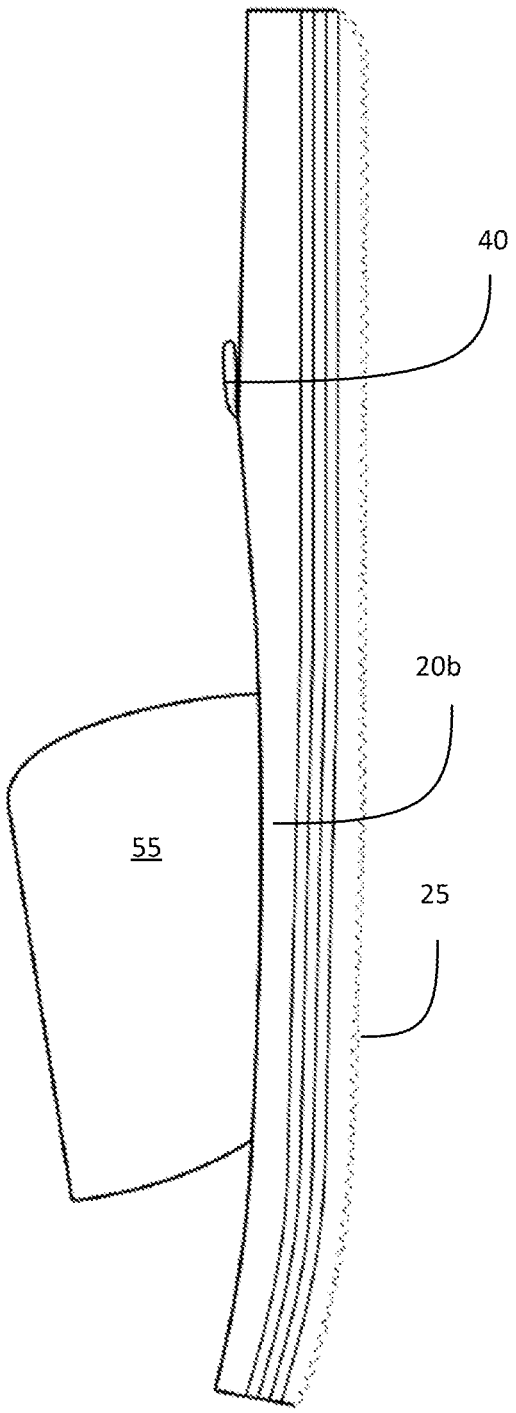
FIG. 19 is a first side view of footwear with the forefoot strap.

FIG. 19 is a first side view of footwear 10 with wide forefoot strap 55.

Figure 20:
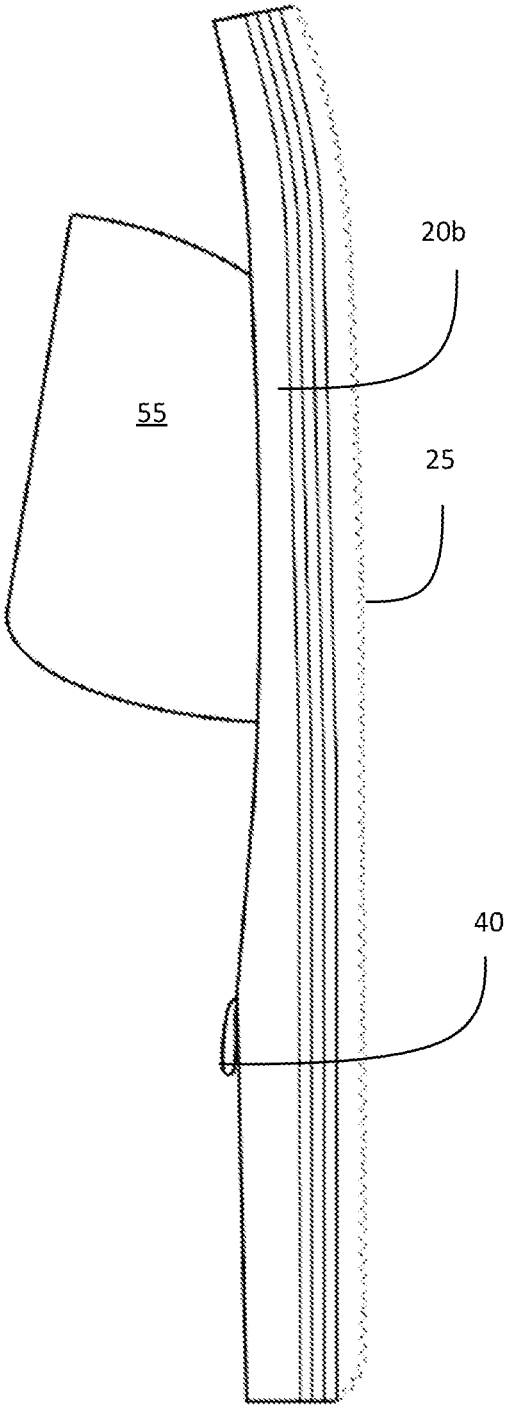
FIG. 20 is a second side view of footwear with the forefoot strap.

FIG. 20 is a second side view of footwear 10 with wide forefoot strap 55.

Figure 21:
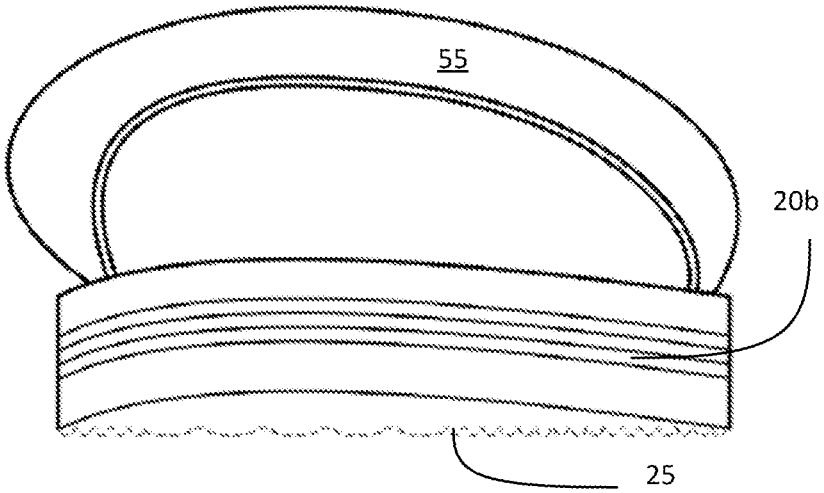
FIG. 21 is a front view of footwear with the forefoot strap.

FIG. 21 is a front view of footwear 10 with wide forefoot strap 55.

Figure 22:
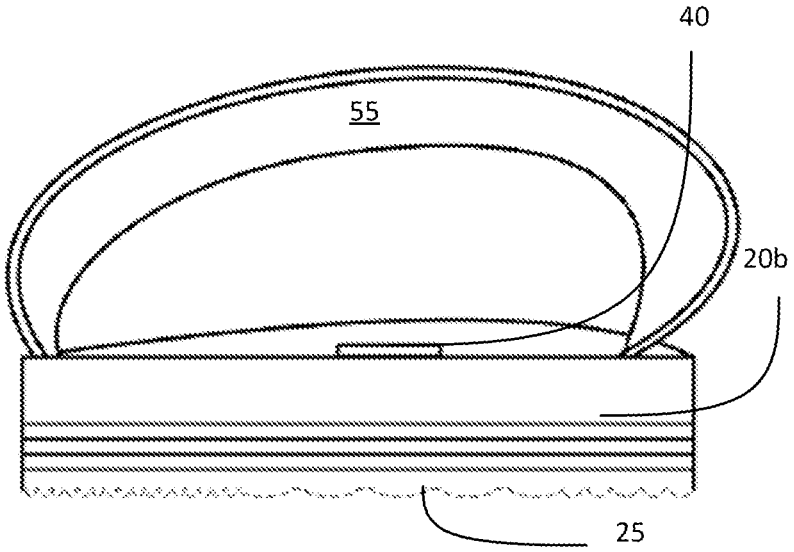
FIG. 22 is a rear view of footwear with the forefoot strap.

FIG. 22 is a rear view of footwear 10 with wide forefoot strap 55.

While footwear 10 that is capable of changing between a flip flop or a slide into a sandal has been provided in the present disclosure, it should be understood that they have been presented by way of example, and not by limitation. For example, the shape, materials of construction and design of footwear 10, as illustrated and described were not intended to be limiting. It should be noted that the measurements/dimensions provided in the present disclosure may change (e.g., scale up/down) based on the size and shape of footwear 10. For example, for large footwear sizes, the dimensions of the compartments, flap portions, straps, etc., may be larger than for small footwear sizes.

A latitude of modification, change and substitution is intended in the foregoing disclosure, and in some instances, some features of the exemplary aspects described herein will be employed without a corresponding use of other features. Accordingly, it is appropriate that the appended claims be construed broadly and in a manner consistent with the spirit and scope of the present disclosure.

The invention claimed is:

1. Footwear comprising:

a sole including a forefoot section, an arch section and a heel section;

a forefoot strap positioned and extending over at least a part of the forefoot section, and being secured to the forefoot section of said sole;

a compartment located in the arch section of the sole, wherein the compartment houses a horizontal strap capable of moving between a first stored position within said compartment and a second raised position outside of the compartment; and a flap portion of the sole, wherein the flap portion covers the compartment and is capable of being lifted to access the horizontal strap in the compartment.

2. The footwear of claim 1, further comprising a gripping element attached to the flap portion.

3. The footwear of claim 1, wherein the flap portion is a cutout in the arch section of the sole.

4. The footwear of claim 1, wherein the flap portion is lifted about a pivot line in the sole.

5. The footwear of claim 4, wherein the pivot line is provided by a hinge connected to the sole.

6. The footwear of claim 4, wherein flap portion is seamlessly molded into the sole and bends about the pivot line when lifted.

7. The footwear of claim 6, wherein the sole is made of a bendable material such that the flap portion returns to a closed state when being released.

8. The footwear of claim 1, wherein the compartment has a first depth and the flap portion has a second depth such that the flap portion sits flush on the sole when the flap portion is closed.

9. The footwear of claim 1, wherein the compartment includes a first fastening element that connects to a second fastening element disposed on the flap portion.

10. The footwear of claim 1, wherein the second fastening element is attached to a bottom section of the flap portion.

11. The footwear of claim 1, wherein the flap portion is lifted towards the forefoot section and closed towards the heel section.

12. The footwear of claim 1, wherein the flap portion is lifted towards the heel section and closed towards the forefoot section.

13. The footwear of claim 1, wherein the compartment houses at least one terminal end of the forefoot strap.

14. The footwear of claim 1, wherein the forefoot strap is one of: a wide forefoot strap, V-shaped strap, or a Y-shaped strap.

15. The footwear of claim 1, wherein the horizontal strap includes elastic material for adjusting the horizontal strap.

16. The footwear of claim 1, wherein the horizontal strap includes two terminal ends, and at least one of said terminal ends is attached by a buckle, a snap, an adhesive, or a hook and loop fastener to the sole.

17. The footwear of claim 1, wherein the horizontal strap includes two terminal ends, and at least one of said terminal ends is attached by a buckle, a snap, an adhesive, or a hook and loop fastener within the compartment.

* * * * *